US006285120B1

(12) United States Patent
Park et al.

(10) Patent No.: US 6,285,120 B1
(45) Date of Patent: Sep. 4, 2001

(54) SHADOW MASK OF CATHODE RAY TUBE AND MANUFACTURING METHOD THEREOF

(75) Inventors: No Jin Park; Myung Hoon Oh; Sang Mun Kim, all of Kyungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/057,462

(22) Filed: Apr. 9, 1998

(30) Foreign Application Priority Data

Dec. 3, 1997 (KR) ..... 97-65619

(51) Int. Cl.[7] ..... H01J 29/07
(52) U.S. Cl. ..... 313/402
(58) Field of Search ..... 313/402, 403; 148/310, 621; 430/23

(56) References Cited

U.S. PATENT DOCUMENTS 5,605,581 * 2/1997 Inoue et al. ..... 148/310

FOREIGN PATENT DOCUMENTS 61-078033 4/1986 (JP) ..... H01J/29/07
62-174353 7/1987 (JP) ..... C22C/38/54
04-056107 2/1992 (JP) ..... H01F/17/00

* cited by examiner

*Primary Examiner*—Michael H. Day

(57) ABSTRACT

In a color cathode ray tube, a shadow mask has a shadow mask thin plate that includes Fe—Ni. The shadow mask thin plate has a volume ratio, FR of γ-FIBER to a crystal face having {100}<001> cube orientation between 0.5 and 5.0. The volume ratio, FR, is determined according to equations (1), (2) and (3):

$$FR = \frac{f(g)_{\gamma\text{-}FIBER}ValueMean}{f(g)\{100\} < 001 >} \quad (1)$$

$$f(g)_{\gamma-FIBER}ValueMean = \frac{f(g)\{111\} < 110 > + f(g)\{111\} < 112 > + f(g)\{111\} < 123 >}{3} \quad (2)$$

$$f(g)\{hkl\}[uvw] = \frac{dV(g)\{hkl\}[uvw]/V}{dg\{hkl\}[uvw]} \quad (3)$$

wherein g={hkl}[uvw], and V=volume fraction.

2 Claims, 4 Drawing Sheets

SHADOW MASK OF CATHODE RAY TUBE AND MANUFACTURING METHOD THEREOF

BACKGROUND OF THE INVENTION

1. Field of the Invention

The present invention relates to a shadow mask for a color cathode ray tube and a manufacturing method thereof. More particularly, the present invention relates to a shadow mask having a shadow mask thin plate formed of a material having an assembling structure that allows electron beam passing slots thereof to be uniform during etching treatment, and a method for forming the shadow mask by adjusting the assembling structure of the material forming a thin plate thereof so as to enable uniform etching and to decrease deformation during fabrication, thereby preventing generation of a doming phenomenon.

2. Discussion of Related Art

With the development of transmitting systems having an increased number of scanning lines, cathode ray tubes must have high quality image screens and must be able to represent color with high definition.

FIG. 1 is a sectional view illustrating the construction of a representative cathode ray tube. Panel 1 covers fluorescent film 3 on the inner surface thereof, and panel 2 covers a conductive graphite material on the inner surface thereof. Panel 1 and panel 2 are coupled to each other using a fusing glass (not shown). Electron gun 6, which generates electron beam 5, is mounted on neck portion 4 of panel 2. Shadow mask 7, which is supported by frame 8, is positioned on the inner side of panel 1. Deflection yoke 9, which deflects the electron beam 5 in the left and right direction, is mounted on the peripheral surfaces of panel 2, respectively. Inner shield 10, which is provided to prevent the advancing path of electron beam 5 emitted from electron gun 6 from being deviated due to earth magnetic field or a leakage magnetic field, is secured by the frame 8.

If the video signal is input to electron gun 6, thermion is emitted from a cathode of the electron gun 6 toward panel 1. The emitted thermion is accelerated and concentrated by the application of a voltage to each electrode of electron gun 6.

An advancing path of the electron beams emitted from electron gun 6 is adjusted according to a magnetic field generated by deflection yoke 9 mounted on neck portion 4 of panel 2. The adjusted electron beams are scanned across the front surface of panel 1, while being protected from being deformed by inner shield 10. The deflected electron beams pass through slots of shadow mask 7 coupled with the inner side frame of panel 2. After passing through shadow mask 7, the deflected electron beams are finally incident on, and used to heat, the screen (not shown) at predetermined locations. Then, the incident electron beam collides with fluorescent film 3 of the inner surface of panel 1, causing light emissions which represent the image signal.

Generally, shadow mask 7 is used with a rimmed steel or an aluminum killed steel under the specification defined by JISG 3141.

With the recent development of a extremely fine pitch resolution, however, a thermal expansion coefficient of the shadow mask is increased to $11.5 \times 10^{-6} deg^{-1}$. As a result, heat generated due to the collision of shadow mask 7 with the electron beams emitted from electron gun 6 causes the shadow mask 7 to experience thermal-expansion. When the shadow mask expands or contracts, the electron beams passing through the shadow mask may be incident upon a portion of the fluorescent screen other than the predetermined portion of the fluorescent screen. As a result, a color broadening phenomenon, that is, a doming phenomenon, appears undesirably on the screen. This problem is recognized as a serious problem in displays, such as televisions and the like, which pursue a high fine pitch and luminance screen.

Therefore, to control the generation of doming phenomenon, shadow masks are sometimes formed of a material having a low thermal expansion characteristic, such as Fe—Ni Invar alloy (Ni contents of 36% and Fe contents of 64%) having a thermal expansion coefficient of $1.5 \times 10^{-6} deg^{-1}$ (see JPA 61-78033 and JP Patent Publication No.62-174353 ).

The shadow mask made of Invar alloy is etched to form electron beam passing slots on the mask plate, which is a thin plate. After several hundreds of thousands to millions of slots are formed, the shadow mask is subjected to a heat treatment and to a forming process in which it is shaped into a curved surface.

In more detail, the thin plate of 0.1 to 0.2 mm in thickness is sequentially subjected to de-greasing, cleaning, photoresist covering, exposure, developing, etching, photoresist film removal, and cutting processes. Furthermore, after completion of the etching process, it is also subjected to annealing, press forming, blackening, welding assembly and packing processes.

Since the Fe-36% Ni alloy contains a great amount of Ni, the cost of the material is relatively high and the etching and pressing quality is deteriorated, as compared with an aluminum killed steel such as a low carbon steel.

Since the Invar alloy exhibits relatively poor etching characteristics, it is difficult to achieve a successful fine pitch operation. Therefore, if a fine pitch is needed, the plate should be designed to be considerably thin. If the plate is designed to be thin, it will lack rigidity after the press forming process is performed, which leads to a weak resistance to the impact against the color cathode ray tube.

In addition, the thin plate is comprised of a specified structure having an effective surface on which the electron beam passing slots are formed, a non-effective surface around the effective surface, and a skirt portion on which the electron beams are not passed. The process used to form this structure is complicated, leading to potential errors.

The thermal expansion characteristic of an Invar alloy is only 1/7 to 1/10 the thermal expansion characteristic of a pure steel. Thus, the low thermal conductivity characteristics combined with the high specifics resistance of Invar alloys lead to reduction or improvement of only about 1/3 of the doming generation in the color cathode ray tube where the Invar alloy is used.

It is therefore considered necessary to improve the etching and mechanical forming qualities of the Invar shadow mask.

JP Patent Publication No. 62-174353 suggests a method for improving the etching and press forming characteristics of the Invar alloy. Specifically, boron(B) is admixed to the Invar alloy to improve {100} assembling structure, and simultaneously chromium(Cr) is admixed to the Invar alloy to reduce breakdown strength. When the thin plate is etched and blackened after the admixture of boron, however, there is a disadvantage that the, blackened film exhibits a low adhesion characteristics.

From these low adhesion characteristics follow various problems. For instance, the blackened film is used to suppress temperature increment in the shadow mask and to improve a thermal radiation characteristic thereof.

Therefore, the thermal radiation characteristic of the Fe-36% Ni alloy—a material of the shadow mask, is seriously reduced if the adhesion of the blackening film is deteriorated. Thus, the doming phenomenon due to increment of temperature and the thermal expansion of the shadow mask is likely to occur if boron is admixed, as suggested by Japanese Patent Application No. 09-56107.

Also, when the blackening film has low adhesion characteristics, uneven surface layers of the blackened Fe-36% Ni Invar alloy result.

Furthermore, other problems are experienced by films using Invar alloys, notwithstanding the addition of boron (B). Specifically, the Fe-36% Ni Invar alloy has a high breakdown strength, causing a spring-back to occur after forming. Also, high precision formation techniques are not generally executed on a predetermined curved surface. Thus, qualities of the products formed are unpredictable.

During the forming process, a warm forming method is generally employed. However, because the relationship between the shadow mask and the fluorescent material screen is not matched, a color broadening phenomenon occurs on the screen.

In addition, to mold the shadow mask made of a Fe—Ni alloy into a structure that has precise lines, the processes used to form the shadow mask, including the annealing process and the process for adjusting the thickness of the thin plate material, are typically managed.

Even if the processes for forming the shadow mask are managed, it is difficult to achieve a mold of the shadow mask of Fe—Ni alloy that is sufficiently precise.

SUMMARY OF THE INVENTION

Accordingly, the present invention is directed to a shadow mask of color cathode ray tube and a manufacturing method thereof that substantially obviates one or more of the problems due to limitations and disadvantages of the related art.

An object of the invention is to provide a shadow ask for color cathode ray tube and a manufacturing method thereof which has excellent etching and forming qualities.

According to an aspect of the present invention, a shadow mask for a color cathode ray tube includes: a shadow mask thin plate including Fe—Ni and having a volume ratio of γ-FIBER assembling structure component made by connecting {111}<110> crystal orientation, {111}<123> crystal orientation, and {111}<112> crystal orientation, the volume ratio ranging from 0.5 to 8.5 of a volume ratio of a crystal face having {100}<001> cube orientation.

According to another aspect of the present invention, a shadow mask manufacturing method of a cathode ray tube includes the steps of: forging a shadow mask material having a face centered cubic lattice structure by executing hot rolling; executing cold rolling; executing heat treatment to have a cube orientation; executing skin pass rolling to thereby obtain a shadow mask thin plate having a volume ratio of γ-FIBER assembling structure component made by connecting {111}<110> crystal orientation, {111}<123> crystal orientation, and {111}<112> crystal orientation, the volume ratio ranging from 0.5 to 8.5 of a volume ratio of a crystal face having {100}<001> cube orientation.

In the preferred embodiment of the shadow mask manufacturing method according to the present invention, preferably, the cold rolling is treated in a cold rolling reduction at one time of about 30 to 50%.

The heat treatment is executed after completion of etching, and is preferably executed under a hydrogen atmosphere.

The skin pass rolling is performed to achieve a reduced thickness that is about 10% of the original thickness, and a warm forming is desirable as the forming method.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings.

DETAILED DESCRIPTION OF PREFERRED EMBODIMENT

Figure 1:
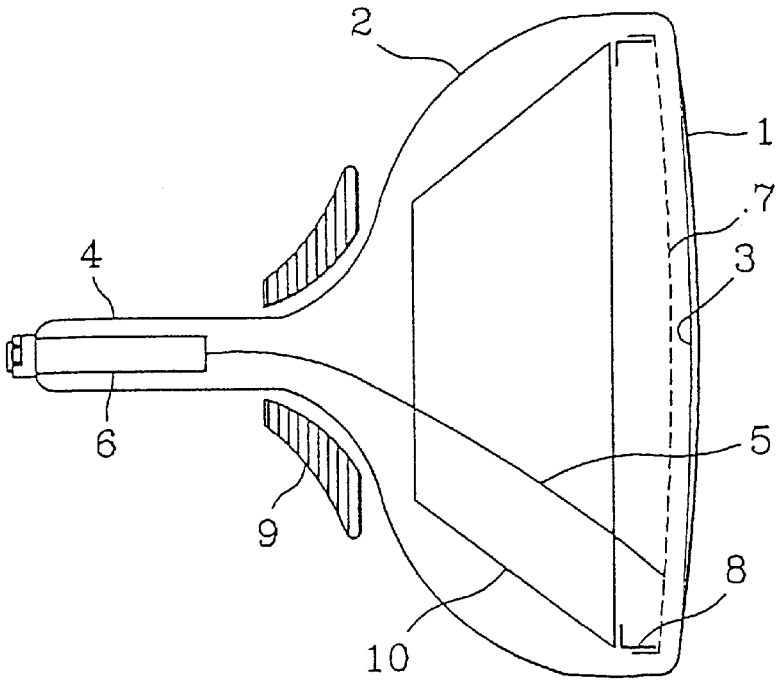
Fig.1 Background Art
FIG. 1 is a sectional view illustrating the construction of a representative cathode ray tube.
Figure 2:
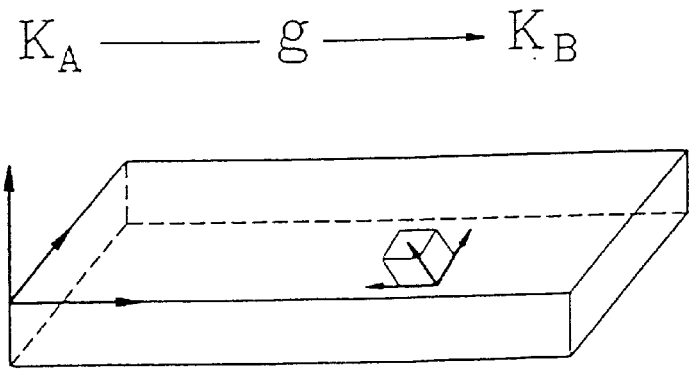
FIG. 2 is a state diagram illustrating orientation of rotation necessary to convert a specimen coordinate system into a crystal coordinate system.

Reference will now be made in detail to the preferred embodiments of the present invention, examples of which are illustrated in the accompanying drawings.

First, an explanation of principles of the present invention will be discussed.

Most metals are comprised of fine polycrystal grains. Crystallographically, the polycrystal grains are seldom distributed in a disordered orientation. Instead, they generally undergo a firing transformation through hot working, cold working, or heat treatment to attain an assembled or ordered structure such as a lattice structure.

In accordance with the structural arrangement of the polycrystal grains, the metal exhibits different mechanical, magnetic, or chemical characteristics.

Particularly, when structured as a recrystallized face centered cubic such as a shadow mask made of face centered crystal, the etching quality of the shadow mask varies in accordance with the orientation of the crystal. In this case, as the number of the structures having a {100} or {111} crystal face is increased, the etching quality thereof is improved. A three-dimensional analysis of the crystalline orientation is how provided for more precise determination.

To fully understand the assembling structure based the orientation distribution of the crystal grains, the relationship between a specimen coordinate system and a crystal coordinate system should be established.

Assuming that a rotation orientation is necessary for converting the specimen coordinate system $K_A$ and the crystal coordinate system $K_B$, the assembling structure having a (hkl)[uvw] crystal orientation can be represented using an orientation distribution function of $f(g)_{(hkl)[uvw]}$. The orientation distribution function indicates the volume ratio of the crystal having a specific rotation orientation within the specimen.

The variable legal for the orientation distribution function f(g)(hkl)[uvw] corresponding to the crystal orientation is designated by the Euler angle $\{\phi, \iota, \phi_2\}$ or the Miller indexes of (hkl)[uvw].

In case of the Miller indexes, the coordinate is set such that (hkl) represents the surface parallel to the rolling orientation and [uvw] represents the rolling orientation, and the orientation distribution function is set as follows:

$$f(g)_{(hkl)[uvw]} = \frac{dV(g)_{(hkl)[uvw]}/V}{dg(hkl)[uvw]} \begin{array}{l} , g = \{\phi_1, \psi, \phi_2\}, \text{ or} \\ , g = (hkl)[uvw] \\ V = \text{volume of fraction} \end{array}$$

Through experimentation, it was discovered that etching quality and speed are improved for the assembling structure comprised of crystal faces having a {100}<001> cube orientation in Invar alloy shadow mask material which has a face centered cubic lattice structure, but the forming quality is deteriorated. To the contrary, if the number of assembling structures having the {111} crystal face is increased, the forming quality was also improved.

Specifically, a γ-FIBER assembling structure component is made by connecting {111}<110> crystal orientation, {111}<123> crystal orientation, and {111}<112> crystal orientation. By developing this γ-FIBER assembling structure component, the forming quality can be correspondingly improved.

The state where the {111} crystal face is developed on the surface of the plate material can be determined from the γ-FIBER assembling structure component. The γ-FIBER assembling structure integrity corresponds to the integrity of a specific {111} crystal face on the vertical surface of the Invar alloy thin plate material.

The crystal orientation g{111}<110> of the assembling structure having the crystal orientation of {111}<110> appearing at Euler angle {60°, 55°, 45°}, the crystal orientation of {111}<123> appearing at Euler angle {79°, 55°, 45°}, and the crystal orientation of {111}<112> appearing at Euler angle {90°, 55°, 45°}, can be expressed using the following mathematical expression:

$$\begin{aligned} f(g)cube = f(g)_{\{100\}\langle 001\rangle} &= \frac{dV(g)_{\{100\}\langle 001\rangle}/V}{dg_{\{100\}\langle 001\rangle}} \begin{array}{l} , g = \{0°, 0°, 0°\}, \text{ or} \\ , g = \{100\}\langle 001\rangle \end{array} \\ = f(g)_{\{111\}\langle 110\rangle} &= \frac{dV(g)_{\{111\}\langle 110\rangle}/V}{dg_{\{111\}\langle 110\rangle}} \begin{array}{l} , g = \{60°, 55°, 45°\}, \text{ or} \\ , g = \{111\}\langle 110\rangle \end{array} \\ = f(g)_{\{111\}\langle 123\rangle} &= \frac{dV(g)_{\{111\}\langle 123\rangle}/V}{dg_{\{111\}\langle 123\rangle}} \begin{array}{l} , g = \{79°, 55°, 45°\}, \text{ or} \\ , g = \{111\}\langle 123\rangle \end{array} \\ = f(g)_{\{111\}\langle 112\rangle} &= \frac{dV(g)_{\{111\}\langle 112\rangle}/V}{dg_{\{111\}\langle 112\rangle}} \begin{array}{l} , g = \{90°, 55°, 45°\}, \text{ or} \\ , g = \{111\}\langle 112\rangle \end{array} \end{aligned}$$

The differences in crystallographic texture, and thus orientation, can be obtained by measuring a pole figure using an X-ray diffraction method and an orientation distribution function f(g).

In more detail, while rotating four pole figures of (111), (200), (220) and (311) in the Invar alloy shadow mask having the face centered cubic lattice structure in all possible directions using a goniometer, the diffraction strength of the crystal grains is measured with the X-ray diffraction method.

After the four pole figures on the specific surface (hkl) within the fracture are measured, the diffraction strength can be obtained by calculating the orientation distribution function f(g) using a harmonic method and positivity. Based on the diffraction strength, the volume ratios of the orientation distributing functions f(g){100}<001>, f(g)(111}<110>, f(g){111}<123> and f(g){111}<112> corresponding to each orientation can be obtained.

Through experimentation, it was also discovered that the forming quality of the shadow mask is greatly improved after the mean value for the volume ratio of the γ-FIBER assembling structure component is obtained by the following expression:

$$(f(g))_{\gamma\text{-}FIBER}ValueMean = \frac{f(g)\{111\}\langle 110\rangle + f(g)\{111\}\langle 112\rangle + f(g)\{111\}\langle 123\rangle}{3}$$

$$FR = \frac{(f(g))_{y\text{-}FIBER}ValueMean}{f(g)\{100\}\langle 001\rangle}$$

where a mean volume ratio(hereinafter, referred to as "FR (Forming Recrystallization)" value) between the γ-FIBER assembling structure component and {100}<001> compound of the assembling structure having the cube orientation ranges between 0.5 to 8.5. Alternatively, as defined above, the FR value could be represented as a ratio of the orientation distribution function of the γ-FIBER to the orientation distribution function of {100}<001> component.

Figure 3A:
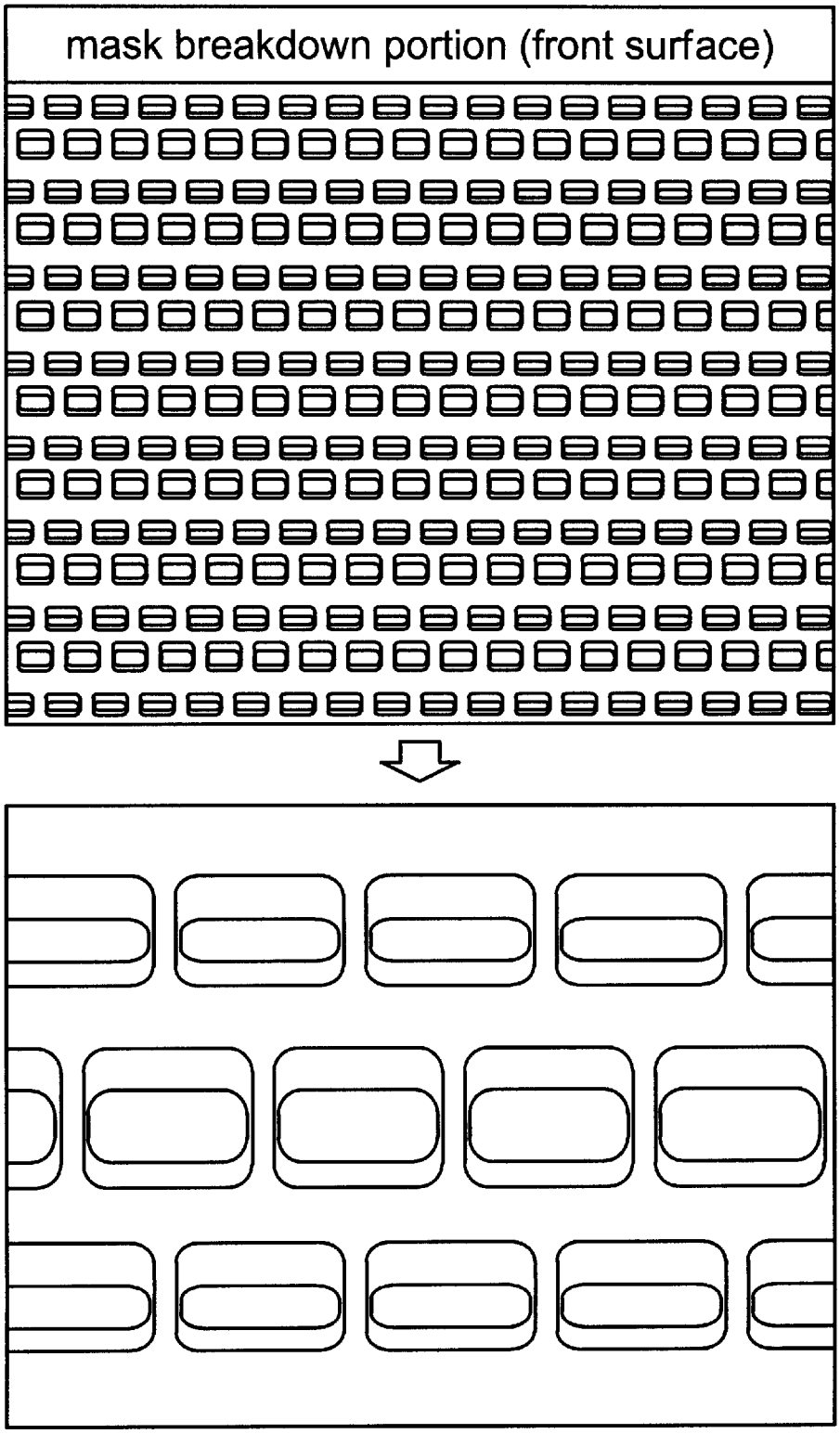
FIGS. 3A–3B illustrate a non-uniform etching pattern when a value of FR is over 5.0.
Figure 3B:
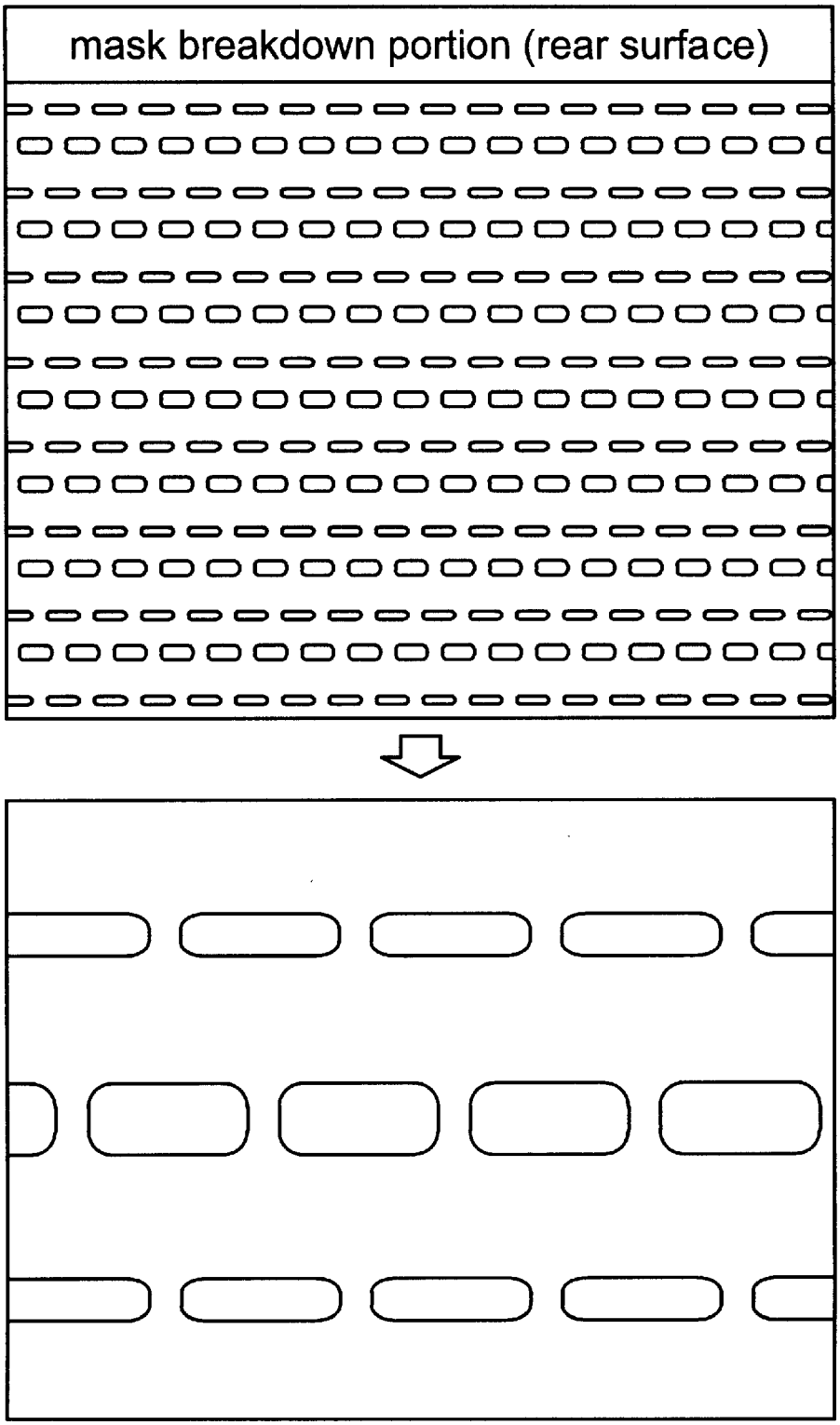

If the FR value is under 0.5, the volume ratio indicated by the orientation distribution function f(g){100}<001> is relatively great As a result, as the {100}<001> assembling structure is developed, the etching of the shadow mask is improved, but the forming thereof is deteriorated. On the other hand, if the FR value is over 8.5, the {111} γ-FIBER assembling structure is developed causing improvements in the formation of the shadow mask. However, the etching is made along the crystal face as shown in FIGS. 3A and 3B. Thus, in either case, the etching state is formed in an uneven manner and the etching speed is slow.

Based upon experimental results achieved by the inventors, both the forming and etching of the shadow mask are improved when the range of FR values is between 0.5 and 8.5.

Figure 4:
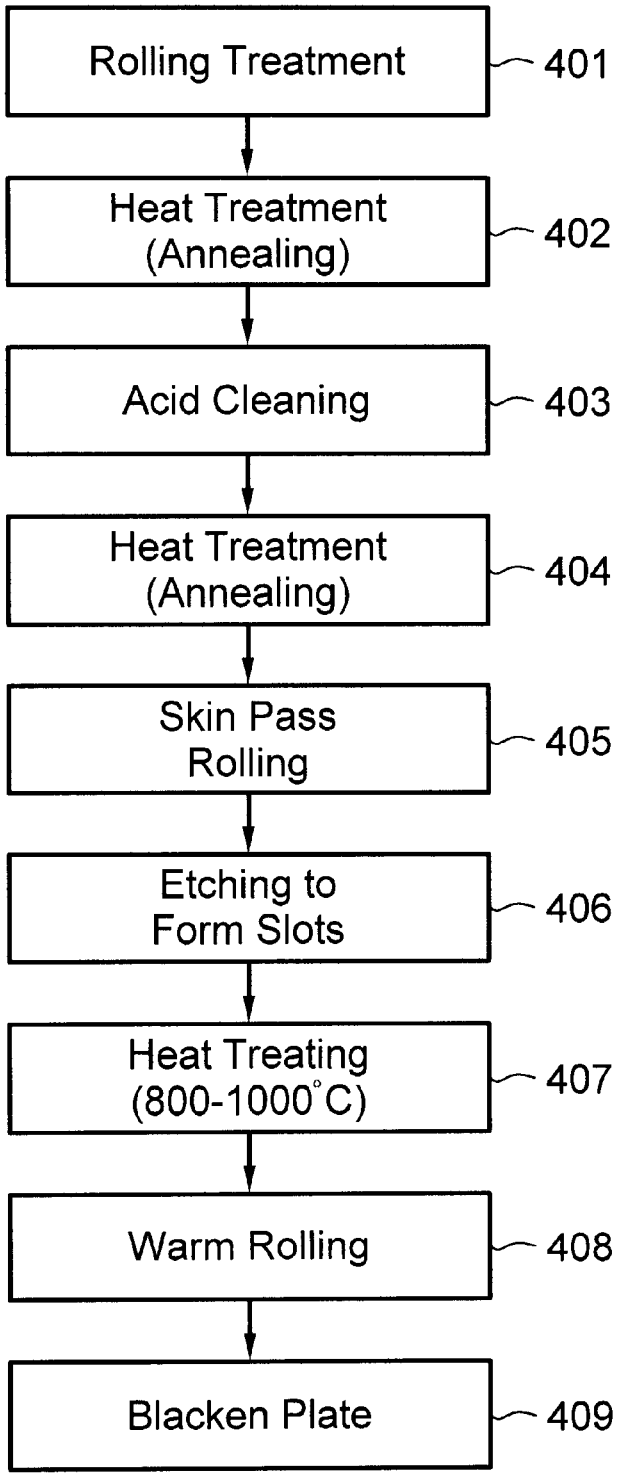
FIG. 4 illustrates a flowchart of steps performed in a preferred embodiment of the present invention.

An explanation of a manufacturing method of a shadow mask made of Invar alloy will now be described with reference to FIG. 4.

After melted steel in a receiver or an electric furnace is injected in an ingot case and a slab is obtained, a rolling treatment is performed (step 401). The rolling treatment may include, but is not limited to, a hot rolling process to form a steel plate of 2 to 5 mm in thickness, and cold rolling and skin pass rolling treatments. The resulting steel plate is formed as a thin plate of 0.1 to 0.2 mm in thickness.

In this process, the cold working treatments are executed to remove the hardening of material and to ensure a good quality of flatness. The cold rolling treatment may be implemented several times at a rate of rolling reduction of 30% to 50% per cold rolling treatment. Then, the plate is subjected to annealing and acid cleaning treatments (Steps 402 and 403). After the acid cleaning treatment of Step 403, the steel plate is annealed under the hydrogen atmosphere at a temperature of 800° C. (Step 404).

Next, the skin pass rolling is performed to adjust the thickness and control the surface to a thickness that is about 10% of the original thickness (Step 405). After completion of cleaning, drying, photoresist covering, and developing processes, the plate is etched with iron chloride solution (Step 406). After the cleaning and drying treatments, the shadow mask plate has a plurality of slots.

The plate is t en subjected to heat treatment at a temperature of 800 to 1000° C. to soften the structure (Step 407), a warm rolling press warmed to the temperature of 200° C. is used to p event the deformation of the plate during the forming treatment (Step 408). The plate is then blackened to obtain a complete shadow mask product (Step 409).

In view of th above-described preferred embodiment of the present invention, the shadow mask manufacturing method will be discussed.

63 wt. % Fe, 36 wt. % Ni, 0.2 wt. % Mn, 0.1 wt. % Cr, 0.01 wt. % C, 0.3 wt. % Mo, 0.05 wt. % Si, 0.01 wt. % B, 0.02 wt. % Cu, 0.4 wt. % Co are composed and vacuum-solved to thereby form ingot.

The ingot is transformed into a wire rod having a diameter of 10 mm by a continuous hot working process. The wire rod is forged in a length orientation to form a plate material having thickness of 2.0 mm and width of 100 mm.

The plate mat rial is subjected to a hot rolling treatment at a temperature of 1200° C., and is repeatedly subjected to continuous cold rolling treatment to form an Invar shadow mask plate material. Next, the plate material is subjected to heat treatment for 2 more hours or more at a temperature of 1100° C. under the hydrogen atmosphere, and is repeatedly subjected to skin pass rolling treatment to achieve a reduced thickness that is about 10% of the original thickness (e.g., to obtain a shadow mask plate material of 0.1 mm in thickness).

The plate is hen subjected to heat treatment at a temperature of 800 to 1000° C. to soften the structure, a warm rolling press warmed to the temperature of 200° C. is used to prevent the deformation of the plate during the forming treatment. The plate is then blackened to obtain a complete shadow mask product.

Sequentially, the plate material is etched with 38 wt. % diiron of chloride solution to form a plurality of electron beam passing slots.

The FR value of the shadow mask plate material is evaluated and the variation of forming characteristic thereof is estimated in accordance with the evaluated FR value, as shown in the following Table <1>.

TABLE 1

| | | | Forming Quality (%) | | |
|---|---|---|---|---|---|
| | FR | Etching Property Roundness | Shape Maintenance | Press Forming | Mask Breakdown Generation |
| NO. 1 | 0.3 | 0.95 | 6 | 95 | 6 |
| NO. 2 | 0.4 | 0.96 | 4 | 98 | 2 |
| NO. 3 | 2.5 | 1.0 | 0 | 100 | 0 |
| NO. 4 | 4.5 | 1.0 | 0 | 100 | 0 |
| NO. 5 | 5.O | 1.0 | 0 | 99 | 0 |
| NO. 6 | 5.3 | 0.98 | 1 | 97 | 0 |
| NO. 7 | 5.5 | 0.95 | 5 | 95 | 1 |
| NO. 8 | 5.8 | 0.92 | 10 | 90 | 3 |

The preferred embodiment of the present invention is evaluated by use of the FR value measuring method which is described as follows. While rotating four pole figures of (111), (200), (220), and (311) in the Invar alloy shadow mask having the face centered cubic lattice structure in all possible directions using a goniometer, the diffraction strength of the crystal grains is measured with the X-ray diffraction method. Using a harmonic method and positivity, the orientation distribution function(ODF) is calculated to obtain the volume ratios indicated by the orientation distribution functions f(g){100}<001>, f(g){111}<110>, f(g){111}<123> and f(g) {111}<112>. Then, a value of $f(g)_{\gamma\text{-}FIBER}$ is obtained, and the FR value is calculated by the following expression:

$$(f(g))_{\gamma\text{-}FIBER}\,ValueMean = \frac{f(g)\{111\}<110> + f(g)\{111\}<112> + f(g)\{111\}<123>}{3}$$

$$FR = \frac{(f(g))_{\gamma\text{-}FIBER}\,ValueMean}{f(g)\{100\}<001>}$$

The etching factor is calculated with a ratio of etching depth to an amount of side etching measured by a microscope. By using the photoresist pattern having a diameter of 100 m, the spray etching is executed. When the etched slot diameter is about 150 m, the etching factor is obtained. Then, the etching conditions are given such that density 42 Baume of solution, temperature of 50° C., and pressure of 2.5 Kgf/cm$^2$is obtained.

When two straight lines parallel to each other are drawn on the etching slot, a degree of power is obtained based on the ratio of maximum distance between the two lines to minimum distance therebetween.

The evaluation of the forming quality is based upon mask breakdown generation ratio, shape maintenance and pressure forming performance.

To calculate the mask breakdown generation ratio, 100 shadow masks are subjected to warm press forming treatment. The bridge portion for each is broken down, as shown in FIG. 3, due to the press in the shadow mask edge portion, which break down is measured using an optical microscope.

The shape maintenance is measured by evaluating the deformation of the mask peripheral portion after the press forming treatment, as the test result utilizing 100 samples.

Finally, for obtaining the press forming performance, after the 100 shadow masks are subjected to warm press forming treatment, it is checked whether the shapes of the treated masks are formed with a desired shape, enabling calculation of the production yield thereof.

It can be appreciated from Table <1> that the etching and forming features of the mask are improved when the FR value ranges from between 0.5 to 5.0. By contrast, both of the etching and forming features of the mask are deteriorated when the FR value is under 0.5 or over 5.0.

As clearly apparent from the foregoing, a shadow mask of color cathode ray tube and a manufacturing method according to the present invention comprises a shadow mask thin plate having a γ-FIBER assembling structure component made by connecting {111}<110> crystal orientation, {111}<123> crystal orientation, and {111}<112> crystal orientation which ranges from 0.5 to 5.0 in volume ratio of a crystal face having {100}<001> cube orientation, to thereby improve the etching and forming features and simultaneously to suppress the doming phenomenon.

It will be apparent to those skilled in the art that various modifications and variations can be made in a shadow mask of color cathode ray tube and a manufacturing method thereof of the present invention without departing from the spirit or scope of the invention. Thus, it is intended that the present invention cover the modifications and variations of this invention provided they come within the scope of the appended claims and their equivalents.

What is claimed is:

1. In a color cathode ray tube, a shadow mask, comprising:

a shadow mask thin plate including Fe—Ni, wherein said shadow mask thin plate has a volume ratio of a γ-FIBER assembling structure component including {111}<110> crystal orientation, {111}<123> crystal orientation and {111}<112> crystal orientation, wherein said volume ratio to a crystal face having {100}<001> cube orientation is between 0.5 and 5.0, and wherein said volume ratio, FR, is determined according to equations (1), (2) and (3)

$$FR = \frac{f(g)_{\gamma\text{-}FIBER}ValueMean}{f(g)\{100\}<001>} \tag{1}$$

$$f(g)_{\gamma-FIBER}ValueMean = \frac{f(g)\{111\}<110> + f(g)\{111\}<112> + f(g)\{111\}<123>}{3} \tag{2}$$

$$f(g)\{hkl\}[uvw] = \frac{dV(g)\{hkl\}[uvw]/V}{dg\{hkl\}[uvw]} \tag{3}$$

wherein g={hkl}[uvw] and V=volume of fraction.

2. The shadow mask recited by claim 1, further comprising:

said color cathode ray tube within which said shadow mask thin plate is positioned, wherein said shadow mask thin plate has enhanced etching and forming properties due to said volume ratio corresponding to said γ-FIBER assembling structure component.

* * * * *